US008647246B2

(12) United States Patent
Murray

(10) Patent No.: US 8,647,246 B2
(45) Date of Patent: Feb. 11, 2014

(54) PRESSURE SEALING SYSTEM

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 429 days.

(21) Appl. No.: 12/880,763

(22) Filed: Sep. 13, 2010

(65) Prior Publication Data

US 2011/0218088 A1 Sep. 8, 2011

Related U.S. Application Data

(60) Provisional application No. 61/241,423, filed on Sep. 11, 2009.

(51) Int. Cl.
*B31B 1/60* (2006.01)

(52) U.S. Cl.
USPC ..... 493/6; 493/9; 493/13

(58) Field of Classification Search
USPC ..... 493/6, 9, 13, 17, 34, 213, 379
See application file for complete search history.

(56) References Cited

U.S. PATENT DOCUMENTS

| | | | | | |
|---|---|---|---|---|---|
| 3,636,678 | A * | 1/1972 | Maros et al. | ..... | 53/412 |
| 3,751,972 | A * | 8/1973 | Hass | ..... | 73/45.4 |
| 4,041,847 | A * | 8/1977 | Spengler | ..... | 493/6 |
| 4,713,046 | A * | 12/1987 | Dupuy | ..... | 493/6 |
| 5,033,254 | A * | 7/1991 | Zenger | ..... | 53/431 |
| 5,111,639 | A * | 5/1992 | Bolejack et al. | ..... | 53/408 |
| 5,181,365 | A * | 1/1993 | Garvey et al. | ..... | 53/455 |
| 5,441,345 | A * | 8/1995 | Garvey et al. | ..... | 383/9 |
| 7,513,858 | B2 * | 4/2009 | Howell et al. | ..... | 493/213 |

* cited by examiner

*Primary Examiner* — Sameh H. Tawfik
(74) *Attorney, Agent, or Firm* — Gifford, Krass, Sprinkle, Anderson & Citkowski, P.C.

(57) ABSTRACT

The present invention discloses a sealing system for sealing together at least a pair of flexible pouch material layers. The sealing station can have a first sealing bar, a second sealing bar and a drive system that is in contact with the first sealing bar. The drive system is operable to move the first sealing bar between an open position and a closed position such that the first sealing bar can apply a predefined pressure on the flexible pouch material layers when positioned or located between the sealing bars. A pressure sensor is also included and in communication with the drive system, the pressure sensor operable to detect if the drive system applies less or too much pressure than the predefined pressure on the flexible pouch material layers located between the first and second sealing bars.

10 Claims, 4 Drawing Sheets

PRESSURE SEALING SYSTEM

CROSS-REFERENCE TO RELATED APPLICATIONS

This application claims priority of U.S. Provisional Patent Application No. 61/241,423 filed Sep. 11, 2009, which is incorporated herein by reference.

FIELD OF THE INVENTION

The present invention relates generally to a sealing system for sealing edges of sheet material together, and in particular, to a sealing system having a pressure sensor operable to detect the amount of pressure applied to sheet material during the forming of a flexible pouch package.

BACKGROUND OF THE INVENTION

Product packages are known to come in various forms, shapes, materials, and the like. One type of product package is a flexible pouch formed from two sheets of pliable material. The sheets of pliable material can be made from a polymeric material and sealed along their edges so as to form a pouch body. In some instances, the edges of the sheets are sealed using heat and pressure such that the polymeric material is melted and forced into contact under pressure in order to produce a water tight and/or liquid tight seal.

Flexible pouches are typically mass produced using flexible pouch machines that can have a pair of spaced apart sealing bars or plates operable to close or move towards each other and apply heat and/or pressure to a pair of polymeric sheets located between the sealing bars. However, the misapplication of either the heat or the pressure can result in improperly formed seals and thus defective pouches. Accordingly, a system for creating a sealed edge between two sheets of pliable material that can detect and monitor pressure and/or heat administered during the fabrication of a flexible pouch package, thereby ensuring that proper seals are provided, would be desirable.

SUMMARY OF THE INVENTION

The present invention discloses a sealing system or sealing station for sealing together a pair of oppositely disposed layers of flexible pouch material. The sealing station can have a first sealing bar and a second sealing bar with a drive system that is in contact with the first sealing bar.

The drive system is operable to move the first sealing bar between an open position and a closed position, the first sealing bar applying a predefined pressure on at least a pair of flexible pouch material layers located between the sealing bars when the first sealing bar is in the closed position. The drive system can be a hydraulic drive system, a pneumatic drive system, a mechanical drive system and the like, and the first sealing bar may or may not slide generally parallel to the second sealing bar when moving between the open position and the closed position.

A pressure sensor is also included with the sealing system and can be in communication with the drive system. The pressure sensor is operable to detect if the drive system applies less or too much pressure than the predefined pressure on the layers of flexible pouch material between the first and second sealing bars. Stated differently, the pressure sensor can detect if the drive system applies a pressure outside of a predefined pressure range, either below or above the range, on the layers of flexible pouch material.

An alarm and/or a programmable controller in communication with the drive system and/or the pressure sensor can also be included. The alarm can alert a user if and/or when the pressure sensor detects that less or too much pressure than the predefined pressure has been applied to the flexible pouch material layers located between the first and second sealing bars when the first sealing bar is in the closed position. The programmable controller can be used to establish or set the predefined pressure to be applied to the pouch layers by the first and second sealing bars. In addition, the programmable controller can activate the drive system to move the first sealing bar between the open position and the closed position, and activate the alarm if less or too much pressure than the predefined pressure is applied to the pouch layers.

In some instances the first sealing bar and/or the second sealing bar have a heated sealing surface which affords for heat to be applied to the layers of flexible pouch material either before, during, and/or after pressure is applied thereto. In this manner, pressure and heat can be applied to flexible pouch material layers located between the first and second sealing bars.

A process for ensuring proper sealing between flexible pouch material layers is also provided. The process includes providing at least a pair of flexible pouch material layers and the sealing system described above. The pair of pouch material layers are placed between the first sealing bar and the second sealing bar when the first sealing bar is in the open position, and thereafter, the first sealing bar is moved to the closed position. The drive system results in a pressure being applied to the pouch material layers and the pressure sensor detects the amount of pressure applied thereto. In the event that the pressure applied to the layers is less or too much pressure than a desired and/or predefined pressure, an alarm in communication with the pressure sensor can alert a user of such an event and corrective action can be taken.

DETAILED DESCRIPTION OF THE INVENTION

Figure 2A:
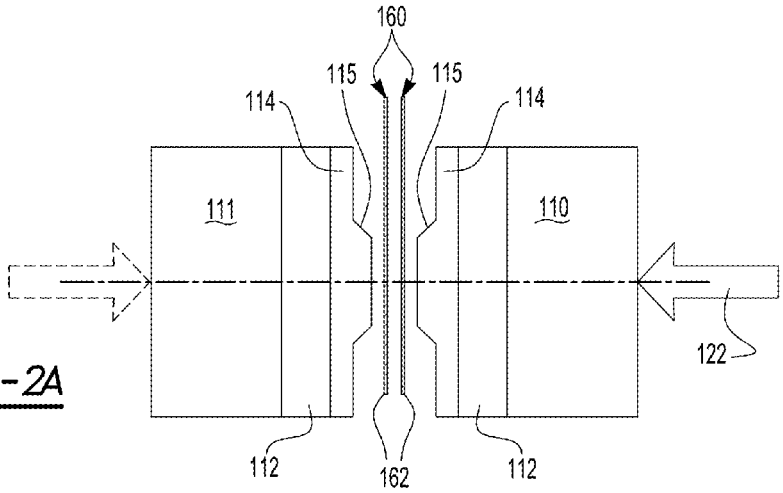
FIG. 2A is a top view of the embodiment shown in FIG. 1A.

The present invention discloses a sealing system, sealing station, sealing machine, etc., for sealing together a pair of flexible pouch material layers which may or may not afford for the manufacture of a flexible pouch package. As such, the present invention has utility as part of a flexible pouch making machine and/or a process for making a flexible pouch package.

The sealing system can include a first sealing bar, a second sealing bar and a drive system that is in contact with or attached to the first sealing bar and/or the second sealing bar. The drive system is operable to move the first sealing bar and/or the second sealing bar between an open position and a closed position such that a predefined pressure is applied to at least a pair of flexible pouch material layers located between the first and second sealing bars. In addition, a pressure sensor in communication with the drive system can be included, the pressure sensor operable to detect if the drive system applies less or too much pressure than the predefined pressure on the flexible pouch material layers. In some instances, an alarm can be provided and be in communication with the pressure sensor. The alarm is operable to alert a user when the pressure sensor detects less than the predefined pressure has been applied to the flexible pouch material layers when the first sealing bar is in the closed position.

The first sealing bar can slide generally parallel in a direction towards and away from the second sealing bar when moving between the open position and the closed position. In addition, the sealing station can include an embodiment in which both the first sealing bar and the second sealing bar move in response to the drive system acting thereon.

The drive system can be a hydraulic drive system with a hydraulic pump, a hydraulic cylinder/piston unit and a hydraulic fluid line therebetween. The hydraulic piston can be engaged with the first sealing bar and/or the second sealing bar. The pressure sensor can be in fluid communication with the hydraulic fluid line and thereby detect the amount of pressure applied to the first sealing bar and/or the second sealing bar when the first sealing bar is in the closed position. In this manner the amount of pressure applied to the flexible pouch material layers located between the first and second sealing bars can be detected and/or measured.

The first sealing bar and/or the second sealing bar can have a heated sealing surface which affords for heat to be applied to the flexible pouch material layers. As such, both pressure and heat can be applied to the flexible pouch material layers located between the first and second sealing bars.

In some instances, a programmable controller can be in communication with the drive system and/or pressure sensor. The programmable controller can activate the drive system to move the first sealing bar and/or the second sealing bar between the open and closed positions. In addition, the programmable controller can be programmed for the drive system to apply a desired amount of pressure to the flexible pouch material layers located between the sealing bars when the first sealing bar is in the closed position A process for ensuring proper sealing of at least a pair of layers located between the first and second sealing bars is also provided. The process includes providing the flexible pouch material layers and the sealing system described above. Thereafter, the layers of flexible pouch material are placed between the first sealing bar and the second sealing bar when the first sealing bar and/or the second sealing bar are in the open position. Once the layers of flexible pouch material are in a desired position or location relative to the first and second sealing bars, the first sealing bar and/or the second sealing bar are moved from the open position to the closed position with sufficient force such that a pressure is applied to the layers of flexible pouch material. Preferably, a predefined pressure is applied to the layers. The pressure sensor detects the actual pressure applied to the layers, and in the event that the actual applied pressure is less or too much pressure than the predefined pressure, an alarm in communication with the pressure sensor can alert a user.

It is appreciated that the sealing system can provide a plurality of seals for a flexible pouch making machine that makes a plurality of flexible pouches. As such, the layers of flexible pouch material can be placed between the first sealing bar and the second sealing bar in an automated fashion. In addition to the pressure, heat can be applied to at least a portion of the first sealing bar and/or the second sealing bar in order to aid in the forming of a seal between the two layers. Similar to the pressure sensor, a temperature sensor can also be included which may or may not be in communication with the alarm such that if less than a desirable temperature is detected at the first sealing bar surface and/or second sealing bar surface, a user can be alerted.

Figure 1A:
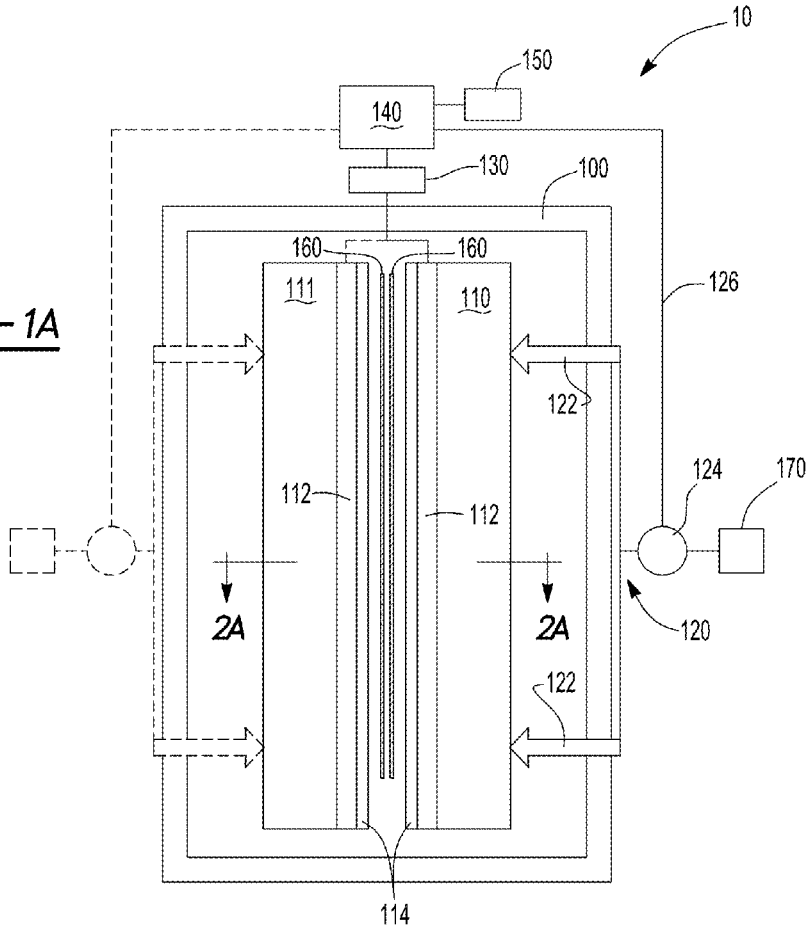
FIG. 1A is a schematic illustration of a sealing system in an open position according to an embodiment of the present invention.
Figure 1B:
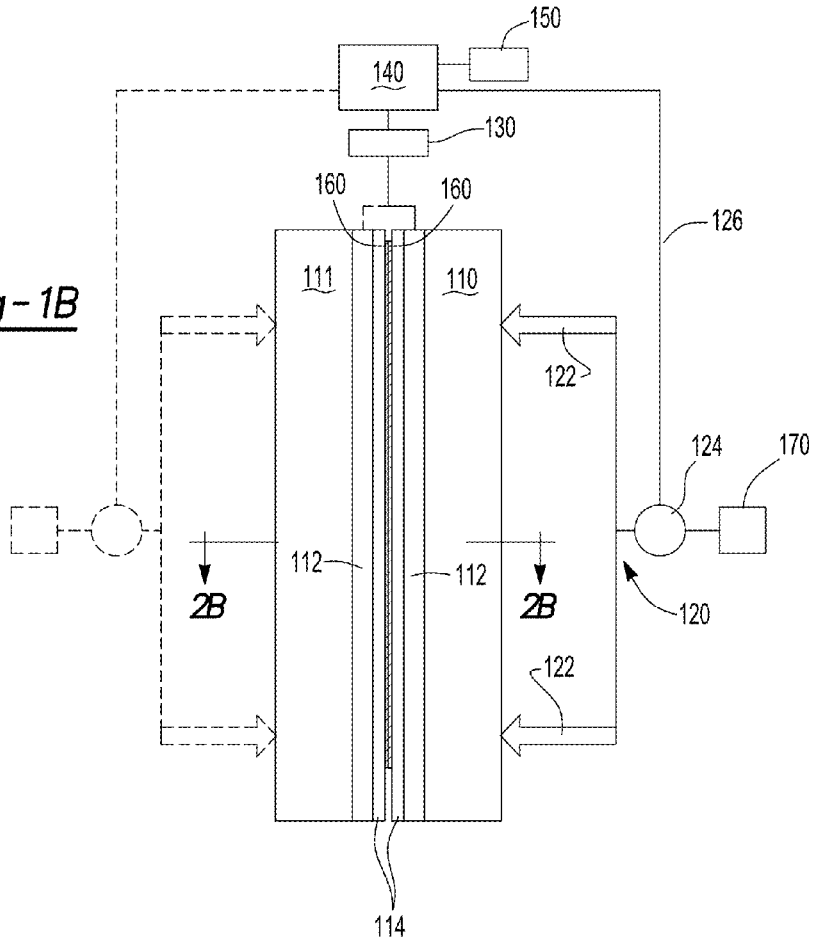
FIG. 1B is a schematic illustration of the sealing system shown in FIG. 1A in a closed position.

Turning now to FIGS. 1A and 1B, a side view and schematic illustration of a sealing system according to an embodiment of the present invention is shown generally at reference numeral 10. The sealing system 10 can have a frame 100 which can support a first sealing bar 110 and a second sealing bar 111. In some instances, the first sealing bar 110 can include a press plate 112 and a seal surface 114. Similarly, the second seal bar 111 can also include a press plate 112 and a sealing surface 114. It is appreciated that the sealing bars 110, 111 can be support bars or support members for the press plat 112 and/or sealing surface 114.

Also included with the sealing station 10 can be a drive system 120 which has one or more actuators 122. For example and for illustrative purposes only, the drive system 120 can be a hydraulic drive system, or in the alternative a pneumatic drive system, with a cylinder/piston unit 122. A pressure sensor 124 can be in communication with a hydraulic or pneumatic line 126 which is further in communication with a pump 140. As is known to those skilled in the art, the pump 140 can provide pressure to a fluid within the line 126 which is used to drive or activate the cylinder/piston units 122 such that pressure is applied to the sealing bar 110 in the direction as shown by the arrows in the figure.

In addition to the sealing system 10, at least two layers 160 of flexible pouch material can be placed and/or located between the first sealing bar 110 and the second sealing bar 111. As such, when the first sealing bar 110 moves in a direction towards the second sealing bar 111, the at least two layers 160 are pressed together and a pressure applied thereto.

A desired pressure to be applied to the layers 160 can be set or programmed using a programmable controller 150 and detected and/or measured using a pressure sensor 124. In the event that less or too much pressure than the desired pressure is applied to the two layers 160 when the first sealing bar 110 is in the closed position, the pressure sensor 124 can communicate with an alarm 170, the alarm 170 being operable to alert an individual that less or too much pressure than the desired pressure has been applied to the layers 160. In this manner, monitoring of seals created between at least two layers 160 of flexible pouch material is afforded.

As shown by the dotted lines in FIGS. 1A and 1B, the sealing station 10 can afford for the first sealing bar 110 and the second sealing bar 111 to move towards and away from each other rather than just the first sealing bar being moved between the open position and the closed position. In addition, one or both of the press plates 112 and/or the sealing surfaces 114 can be heated using a heater 130 such that heat is applied to the layers 160 when the sealing system 10 is in the closed position as shown in FIG. 1B. In this manner, both pressure and heat can be applied to at least two layers of flexible pouch material and a seal provided therebetween. It is appreciated that the heater 130 can be any device or apparatus known to those skilled in the art that will heat a sealing surface, illustrative including an electrical resistance heater and the like.

Figure 2B:
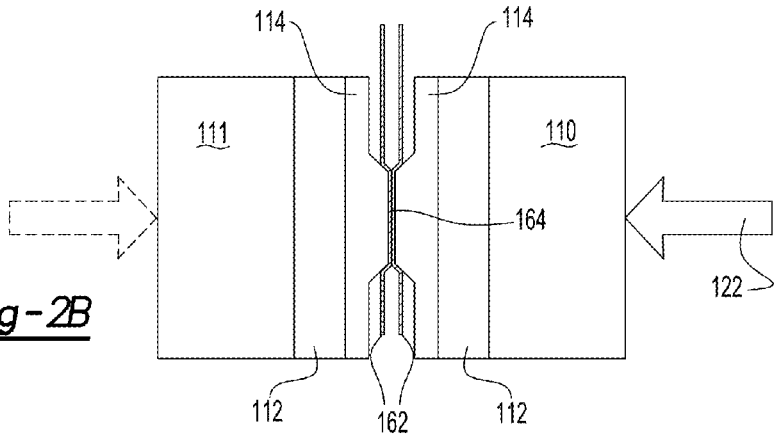
FIG. 2B is a top view of the embodiment shown in FIG. 1B.

Referring now to FIGS. 2A and 2B, top views of sections 2A-2A and 2B-2B, respectively, are shown. In particular, the first sealing bar 110 and the second sealing bar 111 have two layers 160 therebetween along with a pair of press plates 112 and sealing surfaces 114 attached to the sealing bars. The sealing surfaces 114 may or may not have a ridge 115 extending therefrom, the ridge 115 affording for an increase or concentration of pressure and/or heat in a more localized area. In this manner, a more narrow and/or selective region adjacent to end surfaces 162 of the layers 160 can be sealed together as illustrated in FIG. 2B.

Figure 3:
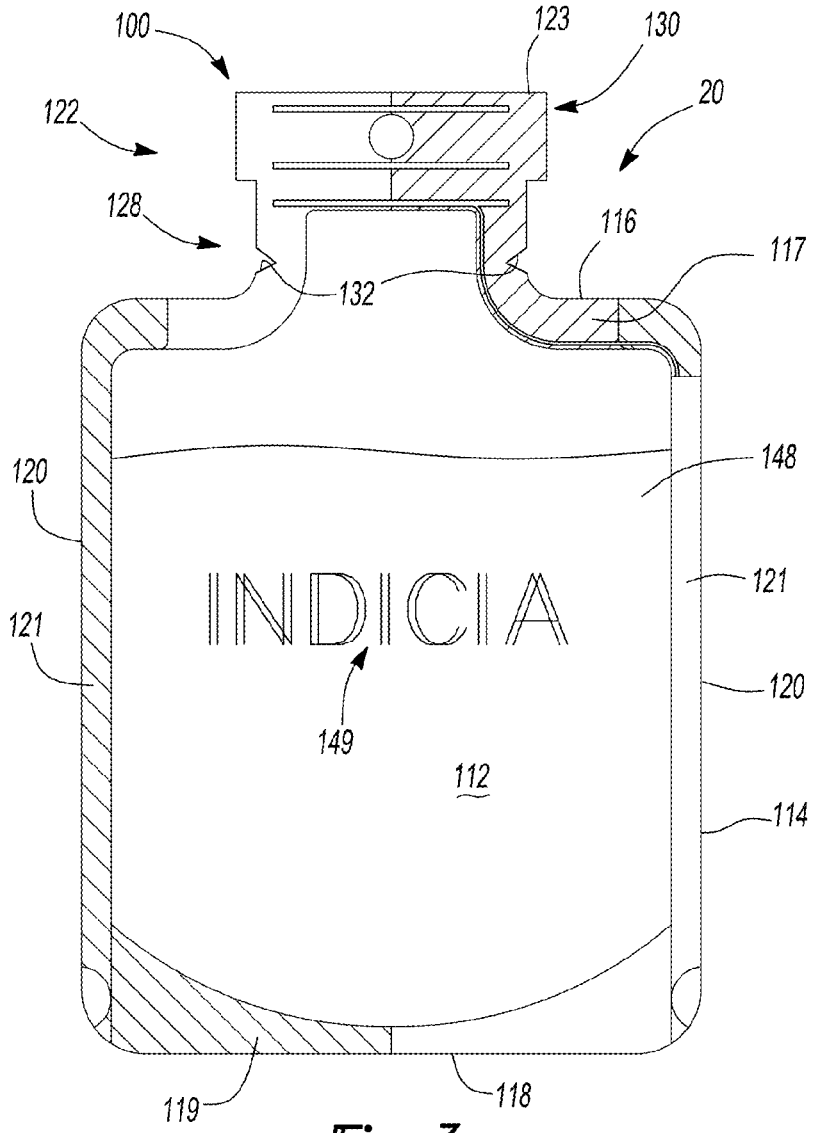
FIG. 3 is a schematic illustration of a flexible pouch container made using a sealing system according to an embodiment of the present invention.

Referring now to FIG. 3, an illustrative example of a flexible pouch container is shown generally at reference numeral 20. The pouch may or may not have an outer layer 148 with indicia 149. The pouch 20 can be defined by one or more panels, for example a front panel 112 and a back panel 114. In addition, one or more side edges 120 can have a seam or seal 121 that affords for joining of the front panel 112 to the back panel 114. It is appreciated that the seam or seal 121 can be formed by the sealing system 10. In addition, the pouch 20 can have an upper edge 116 and a lower edge 118 with a seal 117 and 119, respectively, proximate thereto, the seal 117 and/or 119 also formed by the sealing system 10.

Figure 4:
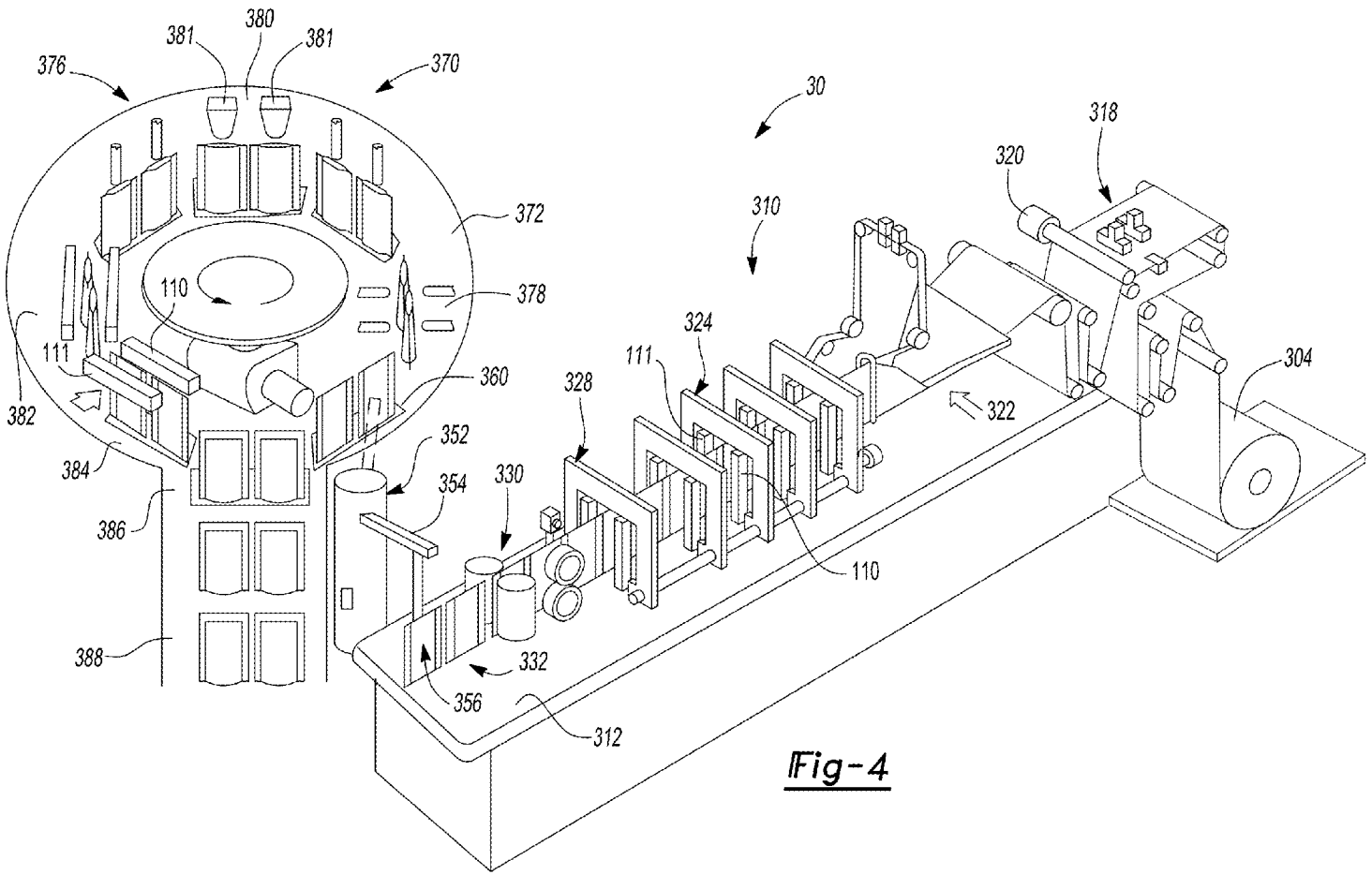
FIG. 4 is a schematic illustration of a pouch making machine made using a sealing system according to an embodiment of the present invention.

Turning now to FIG. 4, a flexible pouch making machine 30 with one or more sealing stations is shown. The machine 30 can include a form line 310 and/or a fill line 370. A roll of material 304 can be provided and used to supply flexible pouch material through an alignment station 318 and rollers 320 that afford for adjustment of the position of the unrolling material 304 to within ±2 degrees relative to a vertically oriented center axis.

The unrolling material 304 can be folded at a folding station 322 such that a pair of adjacent layers of flexible pouch material is provided. Thereafter, the pair of flexible pouch material layers pass through a sealing station 324 which affords for seals along the flexible pouch material layers through the use of one or more sealing bars 110 which may or may not have press plates 112, sealing surfaces 114, etc. The sealing station 324 provides seals along the length of the folded layers which are then directed to a cutting station 330. It is appreciated that one or more sealing stations can be provided along the length of the layers of material, for example and for illustrative purposes only, the first sealing station 324 and a second sealing station 328. In this manner, the sealing process can occur at multiple locations using multiple steps as is known to those skilled in the art. For example, a first tack seal can be conducted at first sealing station 324 and a second tack seal conducted at sealing station 328.

The cutting station 330 can afford for separation or creation of pouches at location 332 by cutting the flexible pouch material along the seams. Thereafter, a flexible pouch mover 352 with a robotic arm 354 can grab the pouches at location 332 and place them on the fill line 370. In some instances, a pouch carrier 360 can be used with the robotic arm 354 placing the pouches at least partially within the pouch carrier 360.

The filling line 370 can move the pouches from one station to another, e.g. from an opening station 378 to a filling station 380, to a third sealing station 382, to a fourth sealing station 384, and the like. It is appreciated that the third sealing station 382 and the fourth sealing station 384 can afford for a top seal to be applied to the flexible pouch containers after they have been filled with product at the product filling station 380. Thereafter, the filled and sealed flexible pouches can proceed along a conveyor 386 to an unloading station 388. It is appreciated that the first through fourth sealing stations 324, 328, 382, 384 can be similar or identical to the sealing system 10.

The present invention has been described in an illustrative manner and the description is not intended to be restrictive on the scope of the invention. The examples and/or embodiments are not intended as limitations on the scope of the invention. Processes, apparatus, machines, systems, and the like described herein are exemplary and not intended as limitations on the scope of the invention. Changes herein and other uses will occur to those skilled in the art. The scope of the invention is defined by the scope of the claims.

I claim:

1. A sealing station for sealing together a pair of oppositely disposed layers of flexible pouch material, said sealing station comprising:

a first sealing bar and a second sealing bar;

a drive system contacting said first sealing bar, said drive system operable to move said first sealing bar between an open position and a closed position, said first sealing bar applying a predefined pressure on a pair of oppositely disposed layers of flexible pouch material located between said first and second sealing bars when in said closed position and producing a seal between the oppositely disposed layers of flexible pouch material and producing a seal between the oppositely disposed layers of flexible pouch material;

a pressure sensor in communication with said drive system, said pressure sensor detecting if said drive system applies less pressure than said predefined pressure on the pair of oppositely disposed layers of flexible pouch material located between said first and second sealing bars; and an alarm in communication with said pressure sensor, said alarm operable to alert a user when said pressure sensor detects less than said predefined pressure, said pressure sensor and said alarm monitoring seals produced by said first and second sealing bars for the purpose of ensuring proper sealing between the oppositely disposed layers of flexible pouch material; and an alarm in communication with said pressure sensor, said alarm operable to alert a user when said pressure sensor detects less than said predefined pressure, said pressure sensor and said alarm monitoring seals produced by said first and second sealing bars for the purpose of ensuring proper sealing between the oppositely disposed layers of flexible pouch material.

2. The sealing station of claim 1, wherein said first sealing bar slides generally parallel to said second sealing bar when moving between said open position and said closed position.

3. The sealing station of claim 1, wherein said drive system is a hydraulic drive system having a hydraulic pump and a hydraulic piston with a hydraulic fluid line therebetween, said hydraulic piston engaged with said first sealing bar.

4. The sealing station of claim 3, wherein said pressure sensor is in fluid communication with said hydraulic fluid line.

5. The sealing station of claim 1, wherein said drive system moves said first sealing bar and said second sealing bar between said open position and said closed position.

6. The sealing station of claim 1, wherein said first sealing bar has a heated sealing surface.

7. The sealing station of claim 1, wherein said second sealing bar has a heated sealing surface.

8. The sealing station of claim 1, wherein said first sealing bar and said second sealing bar both have a heated sealing surface.

9. The sealing station of claim 1, wherein said drive system is a pneumatic drive system.

10. The sealing station of claim 1, further comprising a programmable controller in communication with said drive system, said programmable controller operable to activate said drive system to move said first sealing bar between said open and closed position and to apply said predefined pressure on the pair of flexible pouch material layers located between said first and second sealing bars when said first sealing bar is in said closed position.

* * * * *